US007325878B1

(12) United States Patent
Dehli

(10) Patent No.: US 7,325,878 B1
(45) Date of Patent: Feb. 5, 2008

(54) CHAIR WITH EXTENDABLE FOOTREST

(75) Inventor: Hans Dehli, Dana Point, CA (US)

(73) Assignee: Interactice Health, LLC, Long Beach, CA (US)

( * ) Notice: Subject to any disclaimer, the term of this patent is extended or adjusted under 35 U.S.C. 154(b) by 610 days.

(21) Appl. No.: 10/850,822

(22) Filed: May 21, 2004

Related U.S. Application Data

(60) Provisional application No. 60/472,443, filed on May 21, 2003.

(51) Int. Cl.
*A47C 7/50* (2006.01)

(52) U.S. Cl. ..... 297/423.2; 297/423.26

(58) Field of Classification Search ..... 297/423.36, 297/423.35, 423.34, 423.26, 423.24, 423.23, 297/423.22, 423.2
See application file for complete search history.

(56) References Cited

U.S. PATENT DOCUMENTS

| | | | | | |
|---|---|---|---|---|---|
| 777,941 | A * | 12/1904 | DeFontes | ..... | 297/68 |
| 2,481,133 | A * | 9/1949 | Luketa | ..... | 297/423.2 |
| 3,794,681 | A * | 2/1974 | Caldemeyer | ..... | 297/423.22 |
| 4,336,965 | A * | 6/1982 | Lipp | ..... | 297/423.36 |
| 5,507,562 | A * | 4/1996 | Wieland | ..... | 297/423.2 |
| 5,560,681 | A * | 10/1996 | Dixon et al. | ..... | 297/284.11 |
| 6,517,160 | B2 * | 2/2003 | Marcantoni | ..... | 297/423.36 |
| 6,685,271 | B1 * | 2/2004 | Chang | ..... | 297/423.4 |
| 6,926,366 | B2 * | 8/2005 | Wolters | ..... | 297/423.36 |
| 2006/0006724 | A1 * | 1/2006 | Shimizu | ..... | 297/423.26 |

* cited by examiner

*Primary Examiner*—Milton Nelson, Jr.
(74) *Attorney, Agent, or Firm*—Christie, Parker & Hale, LLP.

(57) ABSTRACT

A chair with an extendable footrest for accommodating users of different height includes a seat frame, a slide frame mounted to slide on the seat frame between a retracted and extended position and a footrest frame mounted on the slide frame to move between down and up positions. A rotatable drive shaft is mounted on the seat frame and an elongated drive arm is secured at one end to the drive shaft. An extending linkage is connected between the other end of the drive arm and the slide frame to move the footrest frame from the down to the up position and thereafter move the slide frame from the retracted to the extended position, when the drive shaft is rotated in one direction. A retracting linkage connected between the said other end of the drive arm and the slide frame serves to the slide frame from the extended to the retracted position with the footrest frame in the up position when the drive shaft is rotated in the opposite direction. The chair may include a massage mechanism incorporated anywhere within the chair, including the footrest.

3 Claims, 18 Drawing Sheets

CHAIN WORM GEAR DRIVE

CHAIR WITH EXTENDABLE FOOTREST

CROSS-REFERENCE TO RELATED APPLICATION

This application claims the benefit of U.S. Provisional Application No. 60/472,443, filed May 21, 2003, the disclosure of which is hereby incorporated by reference.

FIELD OF THE INVENTION

This invention provides an extendable footrest for a chair.

BACKGROUND

There exist a number of chairs having footrests on which a user may relax his or her legs. One such chair with a footrest includes a back massager and a calf and leg massager incorporated in a stationary or rotatable footrest. Examples of the aforementioned massagers are disclosed in U.S. Patent Publications US2002/0161316 and US2003/0006639, the contents of which are hereby incorporated by reference. As massage or non-massage chairs typically should accommodate users of different height, it would be desirable to have a chair with an extendable footrest whereby a user may adjust the location of the footrest to personal preference.

SUMMARY

There is therefore provided according to an exemplary embodiment of the present invention an extendable footrest for a chair, which may or may not incorporate a massage mechanism within the backrest, footrest or other portion of the chair. The chair includes a seat frame, a slide frame mounted to slide on the seat frame between a retracted and extended position and a footrest frame mounted on the slide frame to move between down and up positions. A rotatable drive shaft is mounted on the seat frame and an elongated drive arm is secured at one end to the drive shaft. An extending linkage is connected between the other end of the drive arm and the slide frame to move the footrest frame from the down to the up position and thereafter move the slide frame from the retracted to the extended position, when the drive shaft is rotated in one direction. A retracting linkage connected between the said other end of the drive arm and the slide frame serves to the slide frame from the extended to the retracted position with the footrest frame in the up position when the drive shaft is rotated in the opposite direction.

BRIEF DESCRIPTION OF THE DRAWINGS

These and other features of the present invention will be better understood when read in context of the following detailed description and accompanying drawings, wherein:

FIGS. 1A through 9 illustrate various aspects of an exemplary extendable footrest according to the present invention;

DETAILED DESCRIPTION

Figure 1:
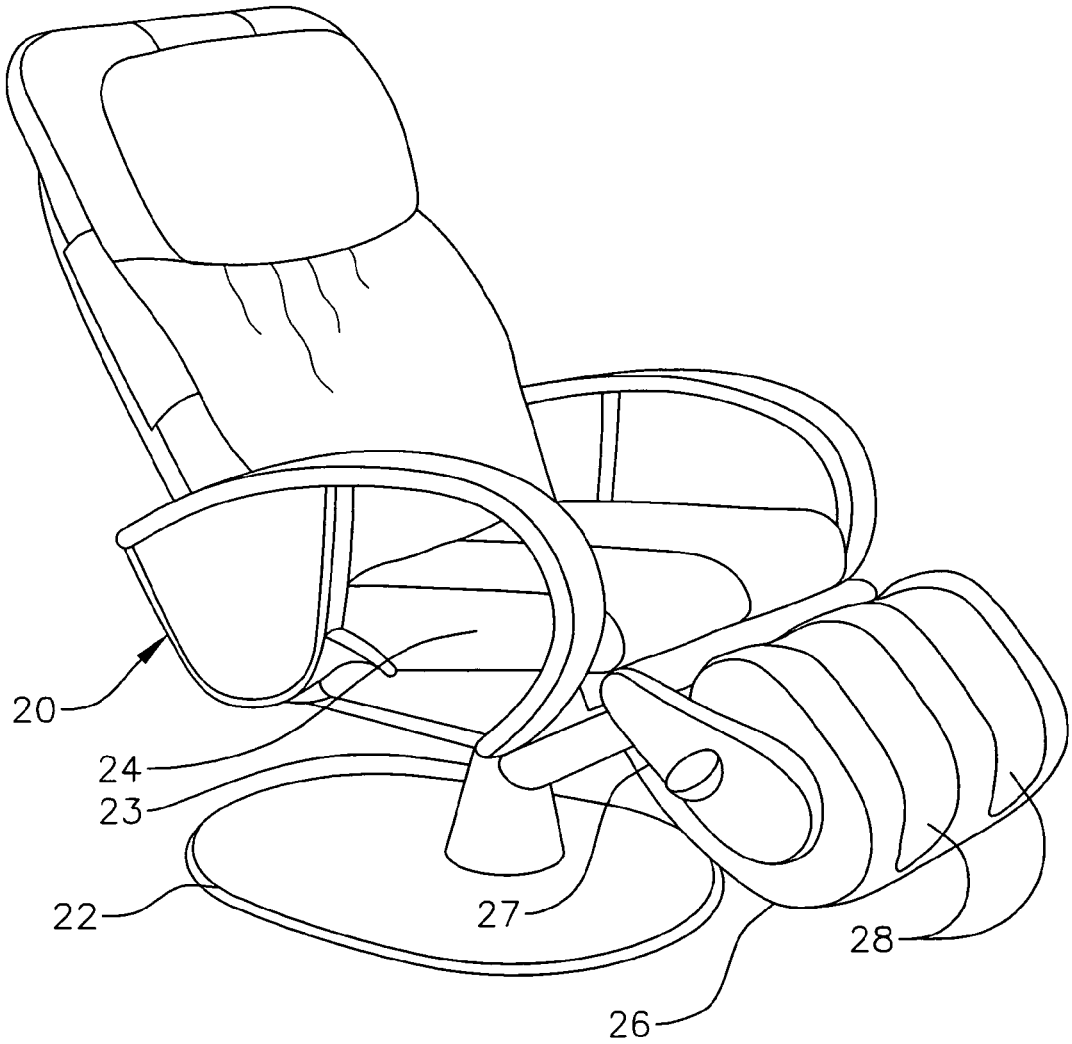
FIG. 1 is a perspective view of an exemplary chair with an exemplary extendable footrest.

Referring to FIG. 1, a reclining chair 20 includes a circular base 22, an upright pedestal 23, a seat 24, and a footrest 26. A separate respective tear drop-shaped end plate 27 is secured to each end of the footrest (only 1 end plate is shown in FIG. 1). The smaller end of each end plate is secured to a slide frame (as described in detail below) so the end plates and footrest can pivot about a horizontal transverse axis.

In brief, the footrest can be deployed from vertical (down position) to horizontal (up position) about the transverse axis, and then be extended forward several inches to accommodate persons of different heights. This is particularly useful with reclining chairs of the type shown in FIG. 1 in which the footrest includes a pair of longitudinally extending and upwardly opening cavities 28 to receive the calves of the person seated in the chair, which can be activated to massage the legs and other parts of the anatomy of the seated person.

Figure 8:
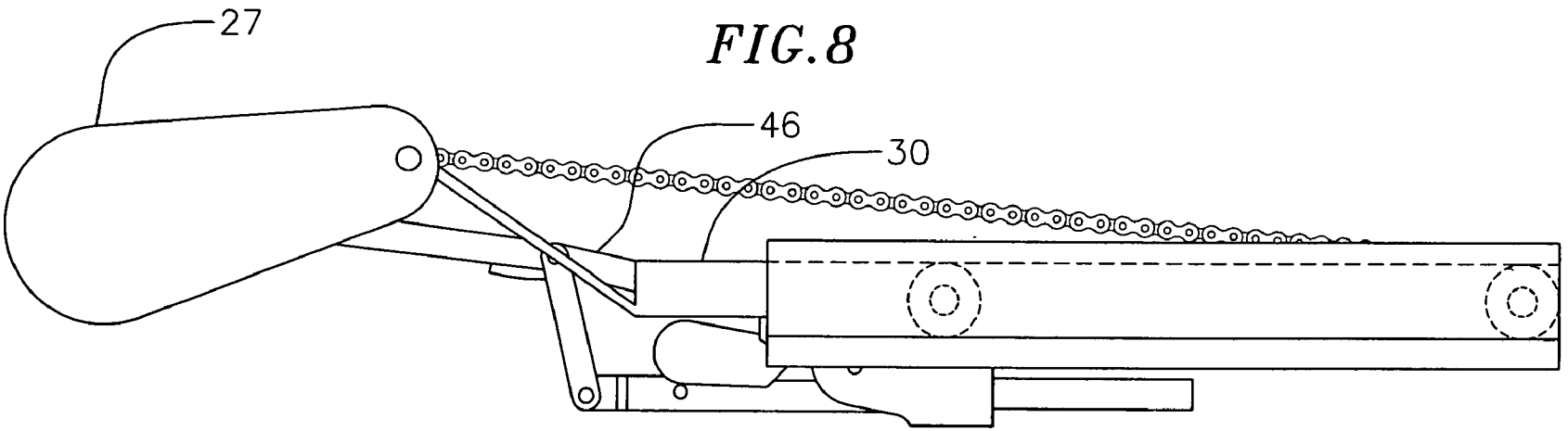
Figure 9:
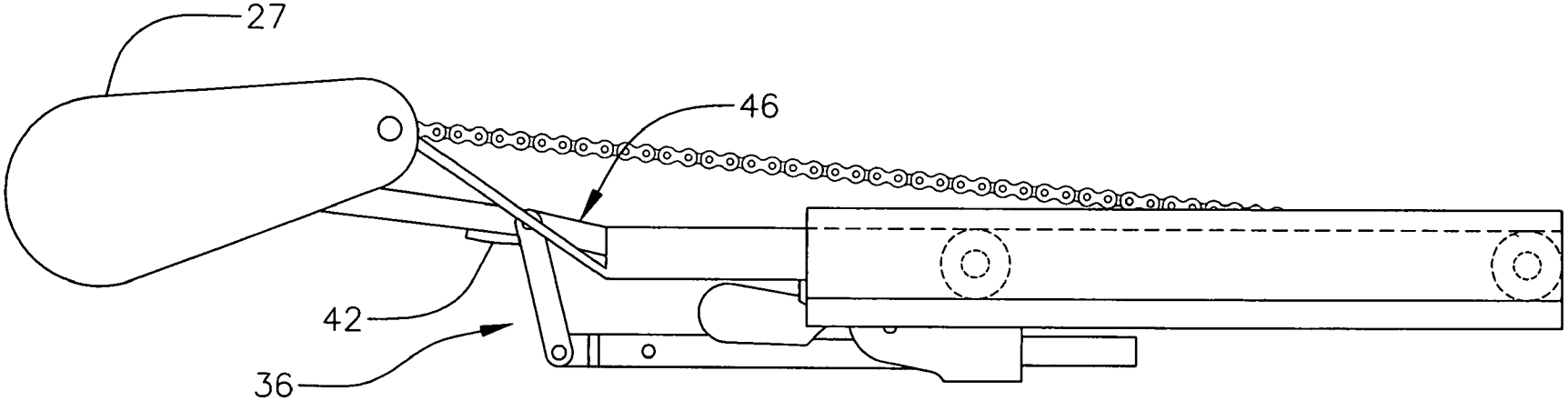

FIGS. 1A-9 show diagrammatically the operation of this invention. A slide frame 30 is mounted in a seat frame 32 to move on rollers 34 (or any other means of transportation, e.g., glide rails, bushings, linear ball bearings, and the like) and slide between a retracted position (FIGS. 1A-7) and an extended position (FIG. 9). FIG. 8 shows the slide frame in an intermediate position between the retracted and extended positions.

Figure 1A:
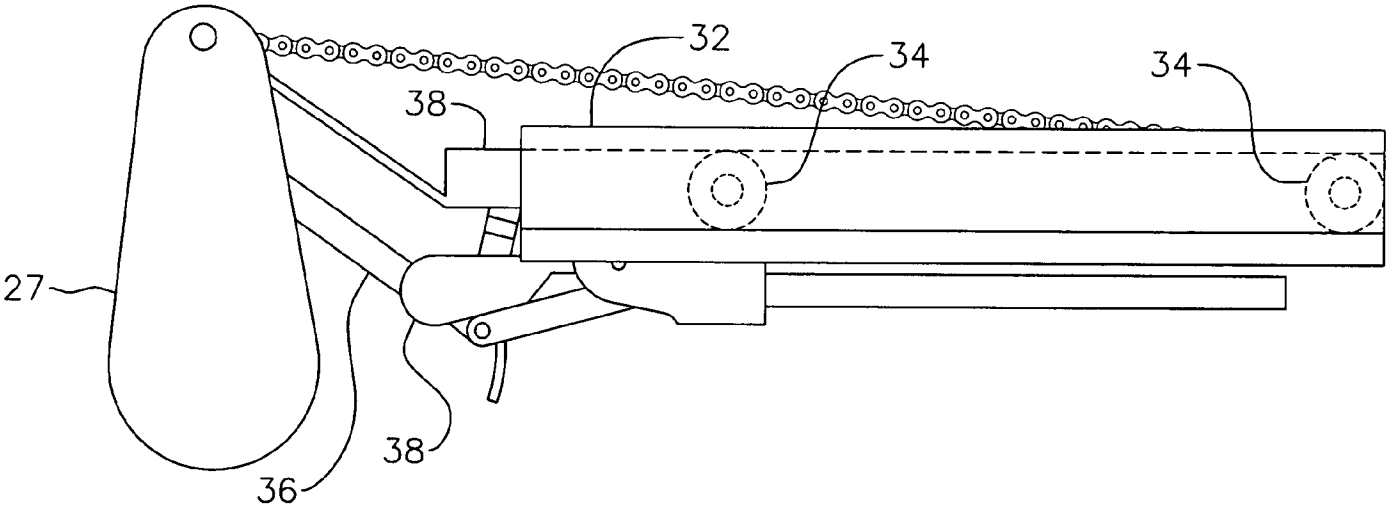
Figure 2:
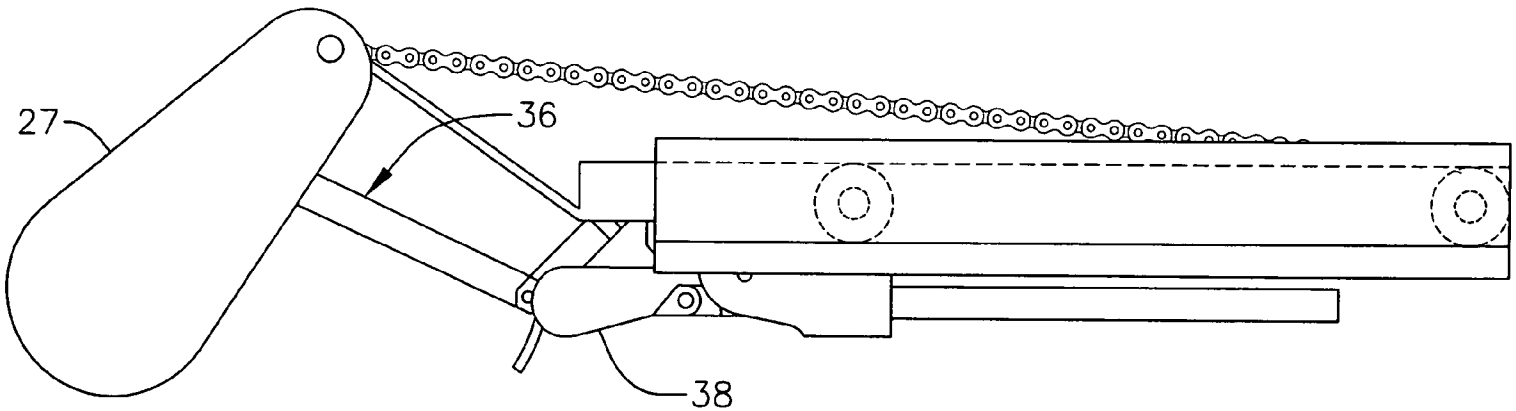
Figure 3:
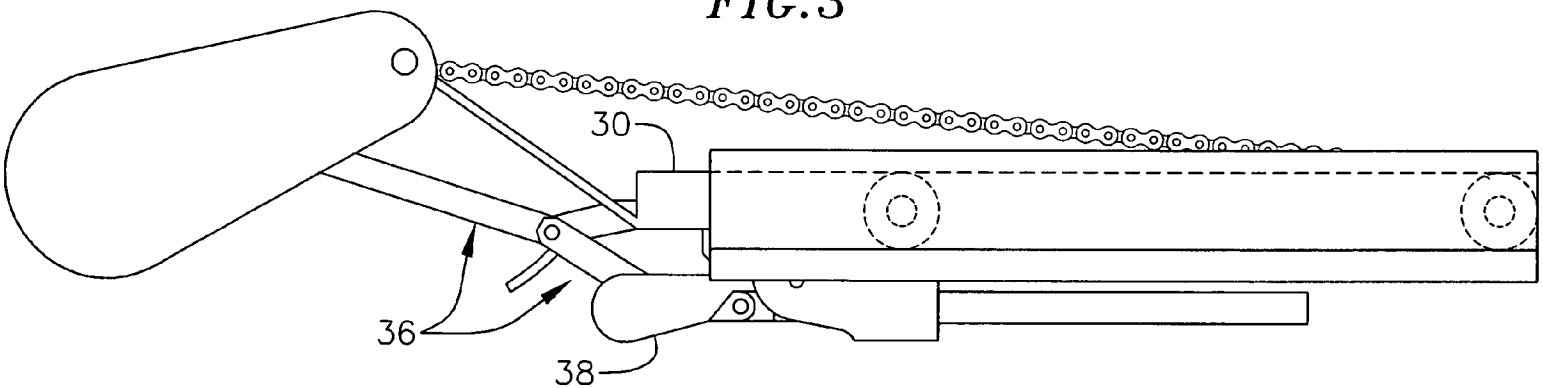
Figure 4:
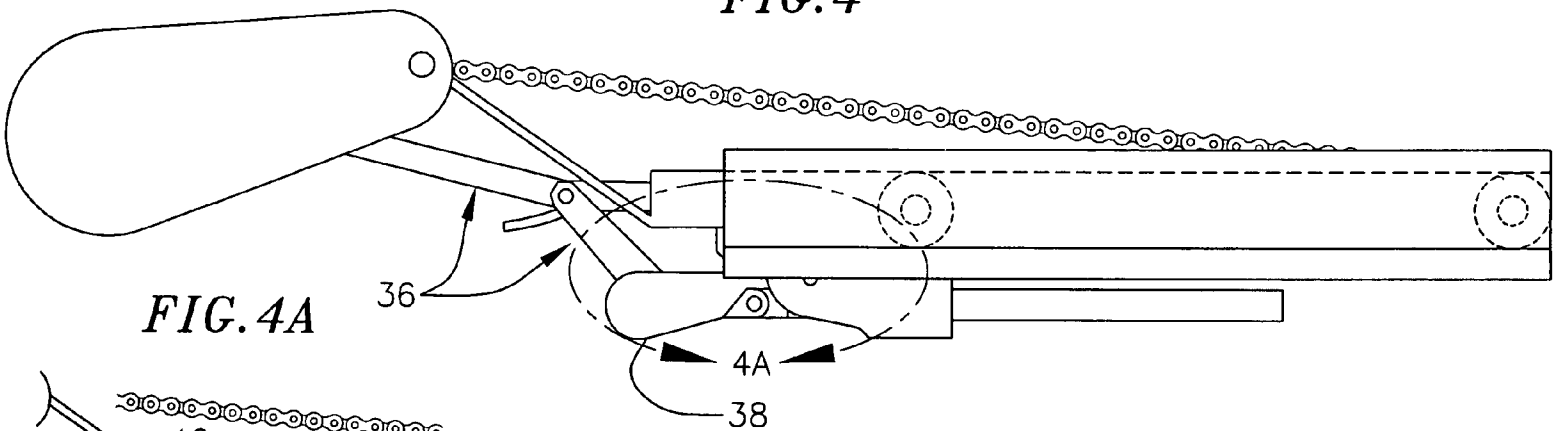
Figure 4A:
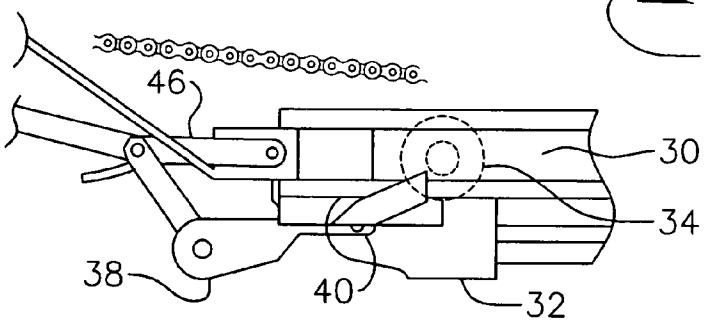
Figure 5:
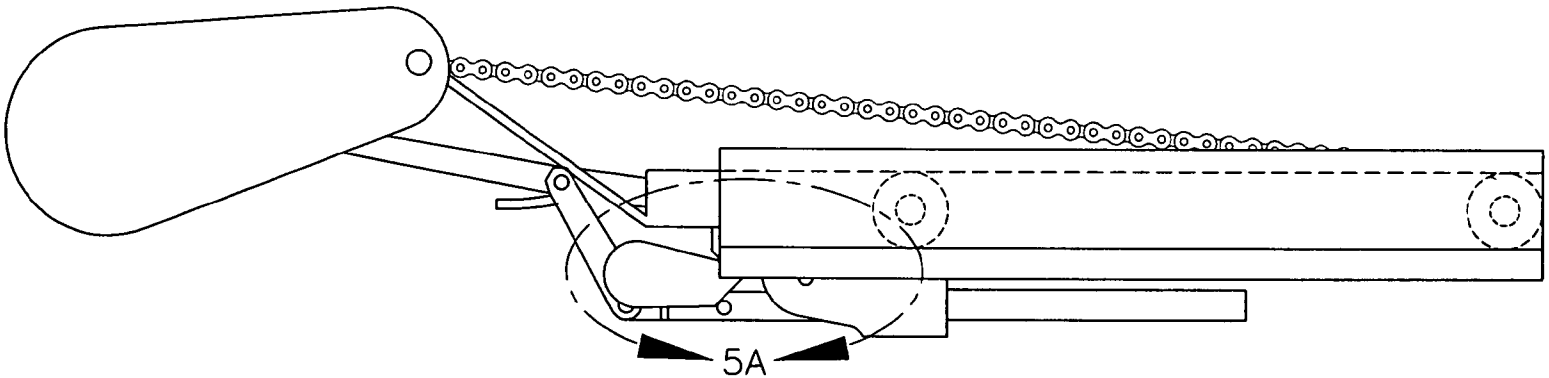
Figure 6:
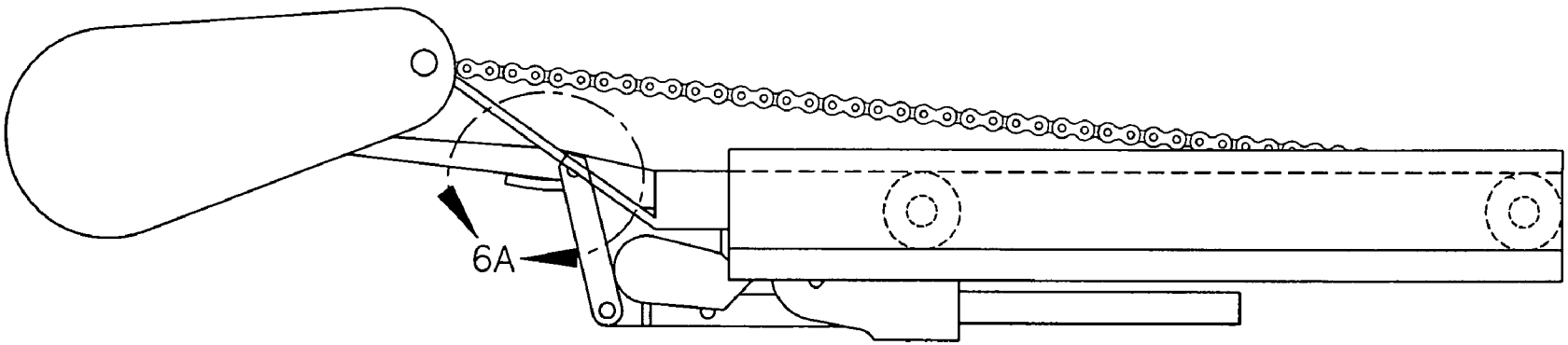
Figure 6A:
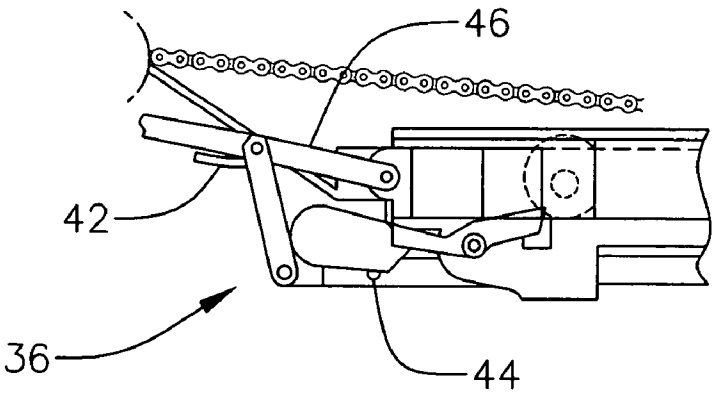
Figure 7:
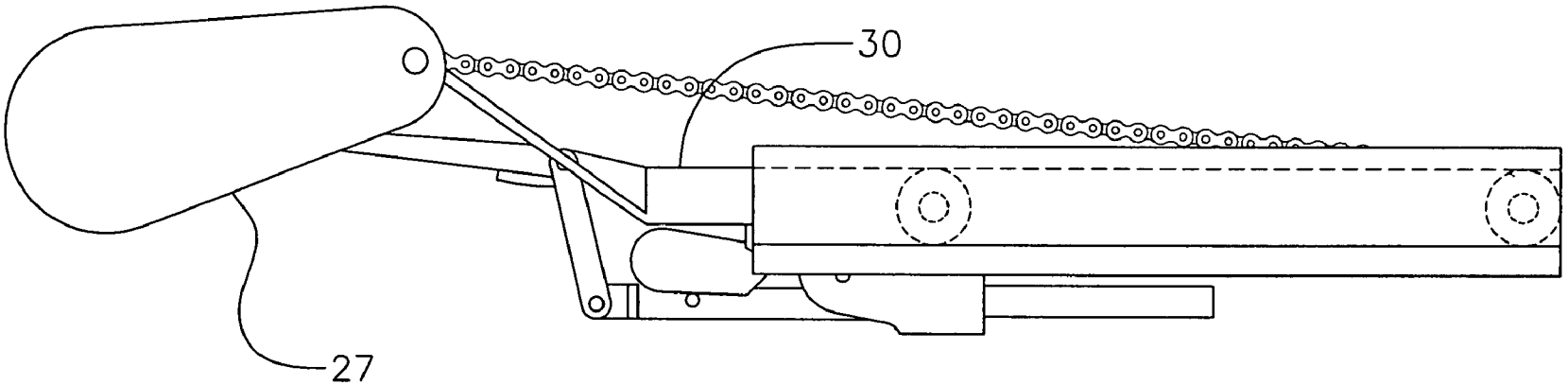

The footrest (shown only as an end plate 27 in FIGS. 1A-9) moves from a full down position as shown in FIG. 1A to a full up position as shown in FIGS. 6 and 6A by operation of an extending linkage 36.

As the footrest moves from the down position shown in FIG. 1A toward the up position shown in FIGS. 6 and 6A, a slide frame lock 38, which is secured to the seat frame 32 by a transverse pivot pin 40 (FIG. 4A-FIG. 6A) remains engaged to lock the slide frame 30 from moving from the retracted toward the extended position. With the footrest in the intermediate (that is, between fully down and fully up) position shown in FIGS. 2-5, the slide frame lock 38 also prevents the footrest from moving down while the mechanism is in any intermediate position.

Figure 5A:
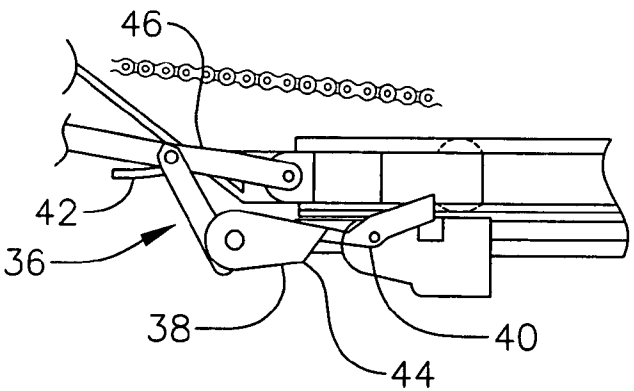

As the footrest approaches the full up position as shown in FIGS. 5-6A, a footrest deployment lock 42 on the extending linkage 36 locks the extending linkage with the footrest in the up position. At the same time, a transverse slide frame lock release shaft 44 (FIG. 5A), engages the underside of the slide frame lock and pivots that lock in a clock wise (as viewed in FIGS. 5A and 6A) direction so the rear end of the slide frame lock moves down and no longer prevents the slide frame from moving from the retracted toward the extended position. Further actuation of the extending linkage 36 after the footrest deployment lock 42 is released (as shown in FIG. 6) causes the slide frame 30 to roll forward (right to left as shown in FIG. 6) from the retracted position shown in FIGS. 1A-6 toward the fully extended position shown in FIG. 9. Thereafter, the operation just described can be reversed so that a retracting linkage 46 acts to unlock the extending linkage 36 and permits the slide to move frame from the extended position to the retracted position. The footrest deployment lock is disengaged so the extending linkage can collapse to afford its original state, and permit the footrest to be moved to the down position shown in FIG. 1A.

The invention is described in more detail below to explain how the extending and retracting linkages are constructed and powered.

Figure 10:
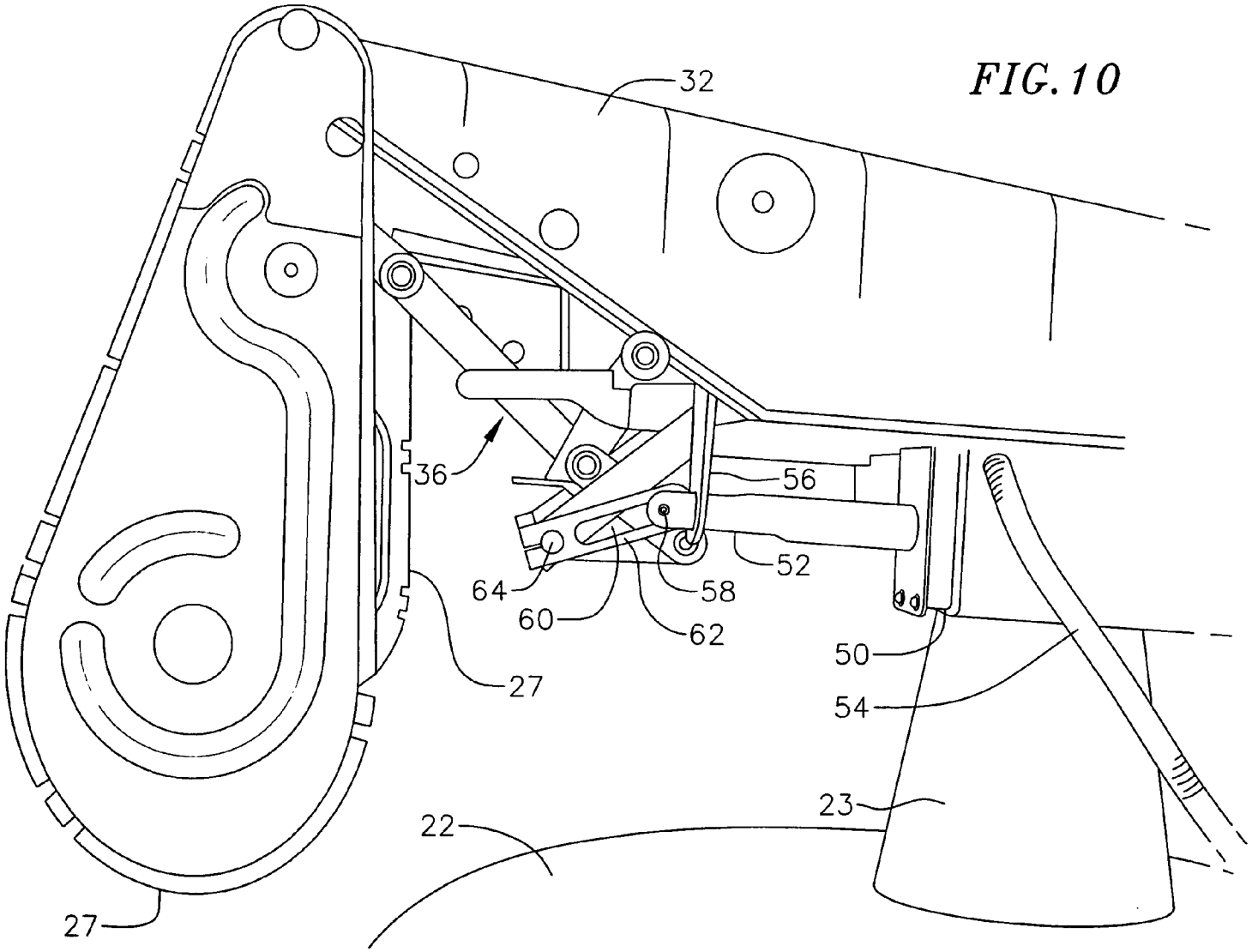
FIG. 10 is a view of the footrest end plates in a full down position, with the slide frame fully retracted within the seat frame.

FIG. 10 shows the footrest end plates 27 in a full down position, with the slide frame 30 (shown best in FIG. 13) fully retracted within the seat frame 32. A linear actuator 50 is bolted to the seat frame 32, and reciprocates a push shaft 52 in a longitudinal direction in response to electrical signals supplied from a control unit (not shown) through an electrical cable 54. The linear actuator is powered by a conventional reversible electric motor (not shown) connected through a conventional gear reduction drive (not shown) to the push shaft 52. The push shaft makes a close sliding fit through a push shaft guide 56 bolted to the seat frame. The forward end of the push shaft is slotted and carries a transverse roller 58, which rides in a longitudinally extending slot 60 of a longitudinally extending crank arm 62, which is rigidly secured at its forward end to a transverse rotatable drive shaft 64 mounted to the forward end of the seat frame 32.

Figure 11:
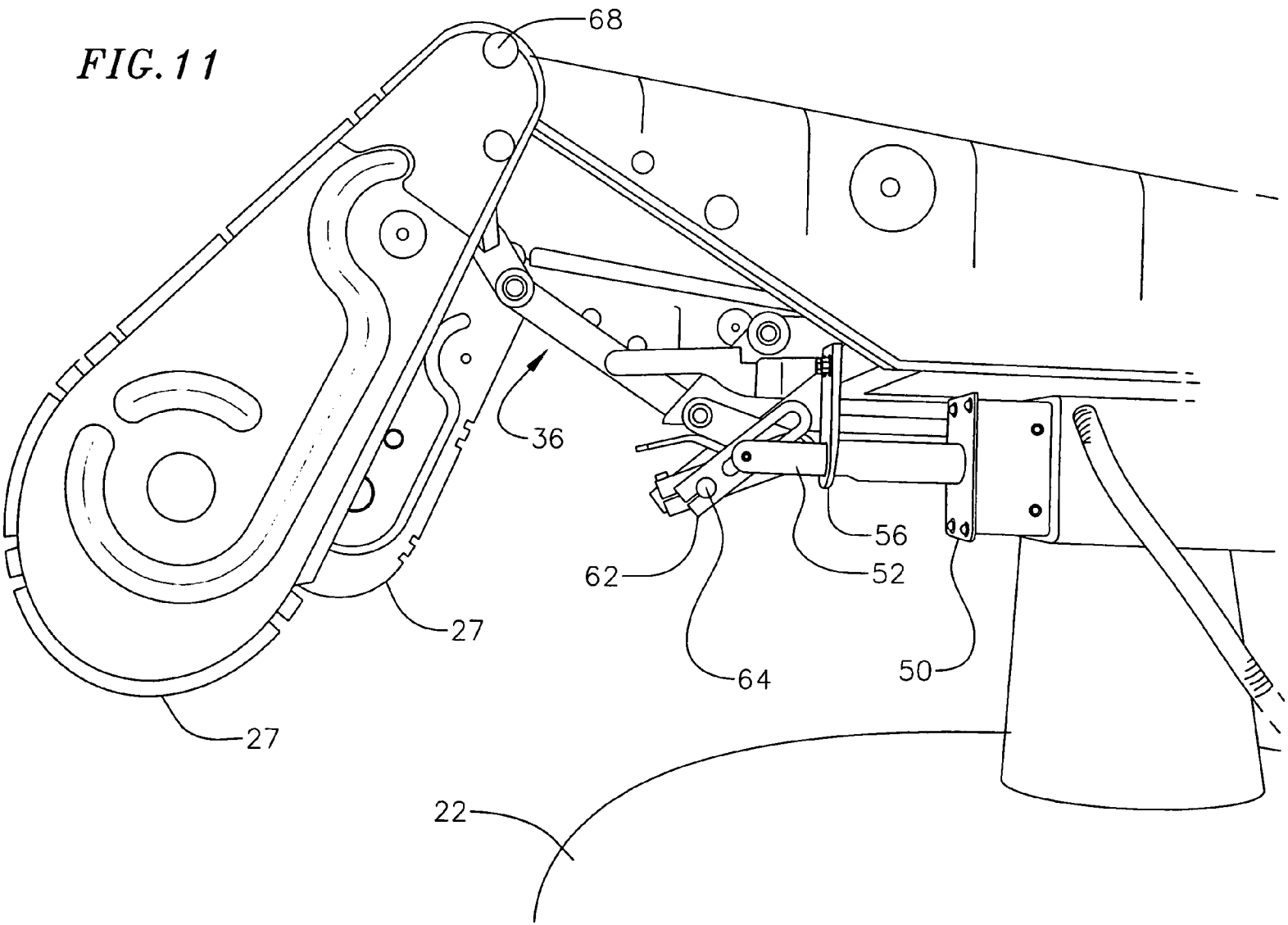
FIGS. 11 and 12 show views of components of the footrest between a fully retracted and a fully extended position.

Referring to FIG. 11, the footrest end plates 27 have been moved to an intermediate position by the push shaft 56 moving forward (to the left as viewed in FIG. 11) so the crank arm 62 and the drive shaft 64 are rotated about 10 degrees in a clockwise (as viewed in FIG. 11) direction. This causes linkage 36 to pivot the slide plates about pivot pins 68 in a clockwise direction.

Figure 12:
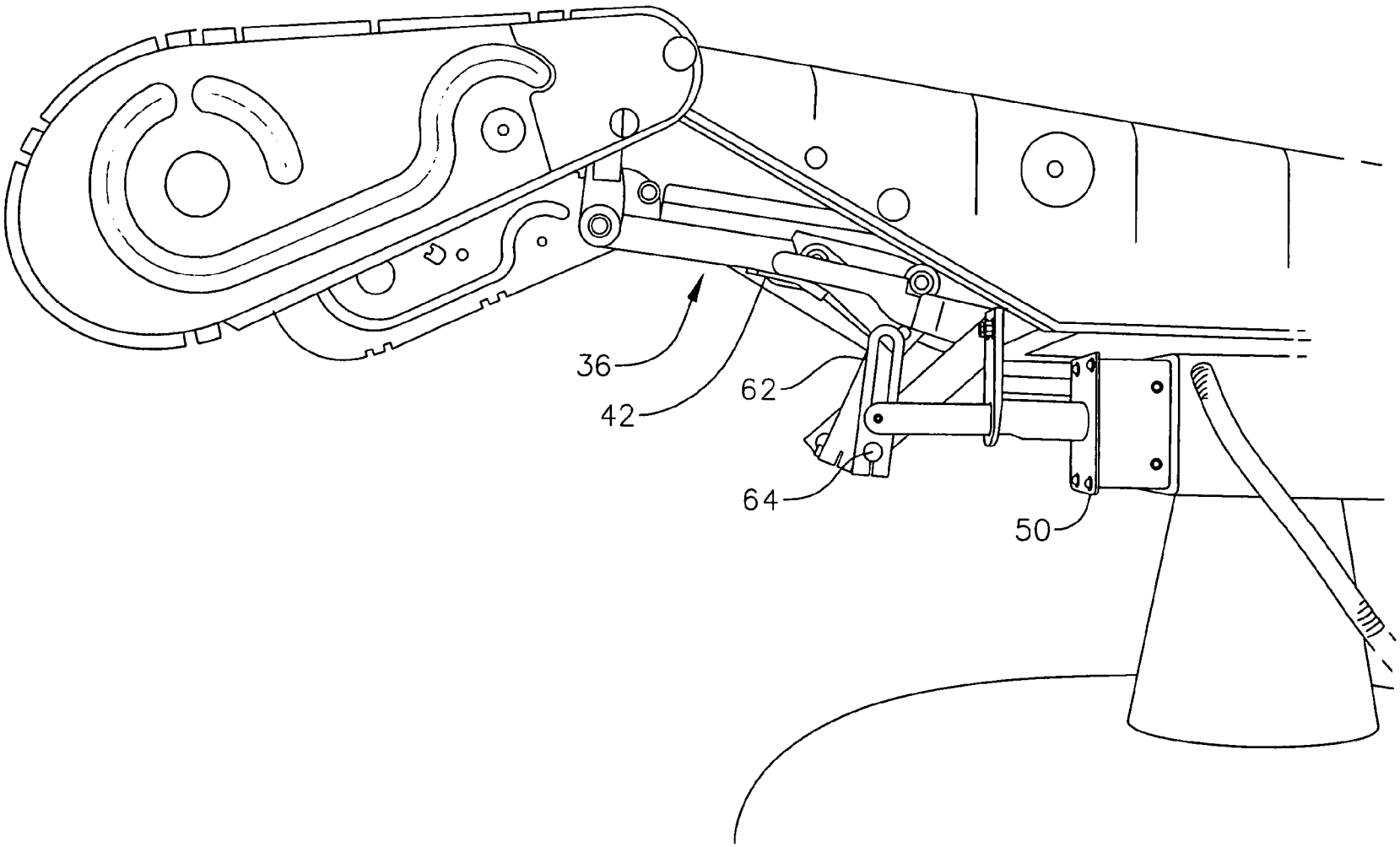

Referring to FIG. 12, further movement of the push shaft to the left (as viewed in FIG. 12) rotates crank arm 62 and drive shaft 64 in a counter clockwise (as viewed in FIG. 12) directions so the linkage 36 moves the side plates 27 (footrest) to the full up position where the footrest deployment lock 42 engages part of extending linkage 36 and locks that linkage and the side plates in the up position.

Figure 13:
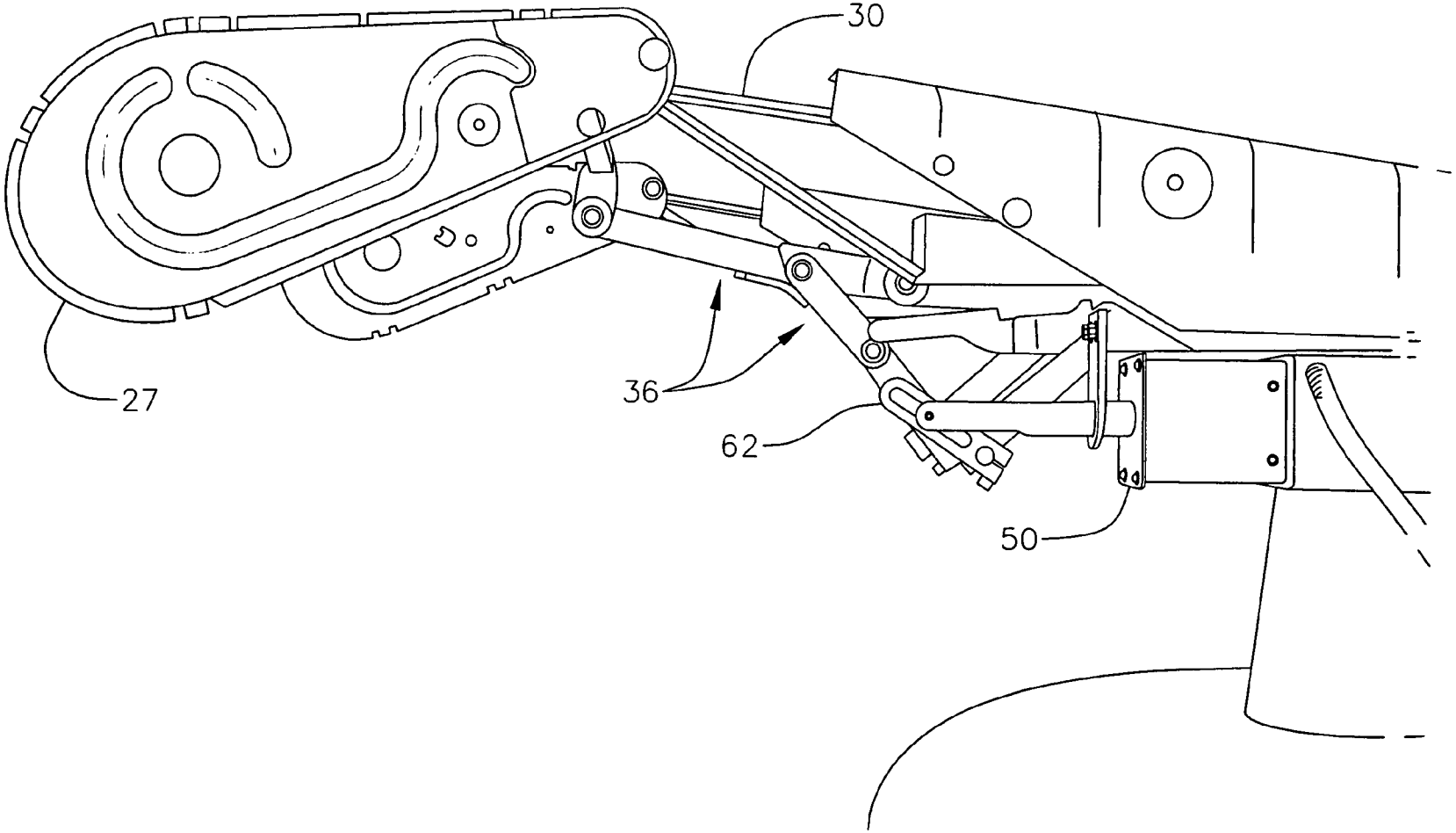
FIG. 13 is a view of the footrest in a fully extended position.

Referring to FIG. 13, further movement of the linear actuator 50 to the left (as viewed in FIG. 13) moves the push shaft and roller forward in the slot of the crank arm, causing the crank arm and drive shaft to rotate counterclockwise (as viewed in FIG. 13) so that linkage 36 forces the slide frame 30 to move from the fully retracted position shown in FIGS. 10-12 to the fully extended position shown in FIG. 13.

Figure 14:
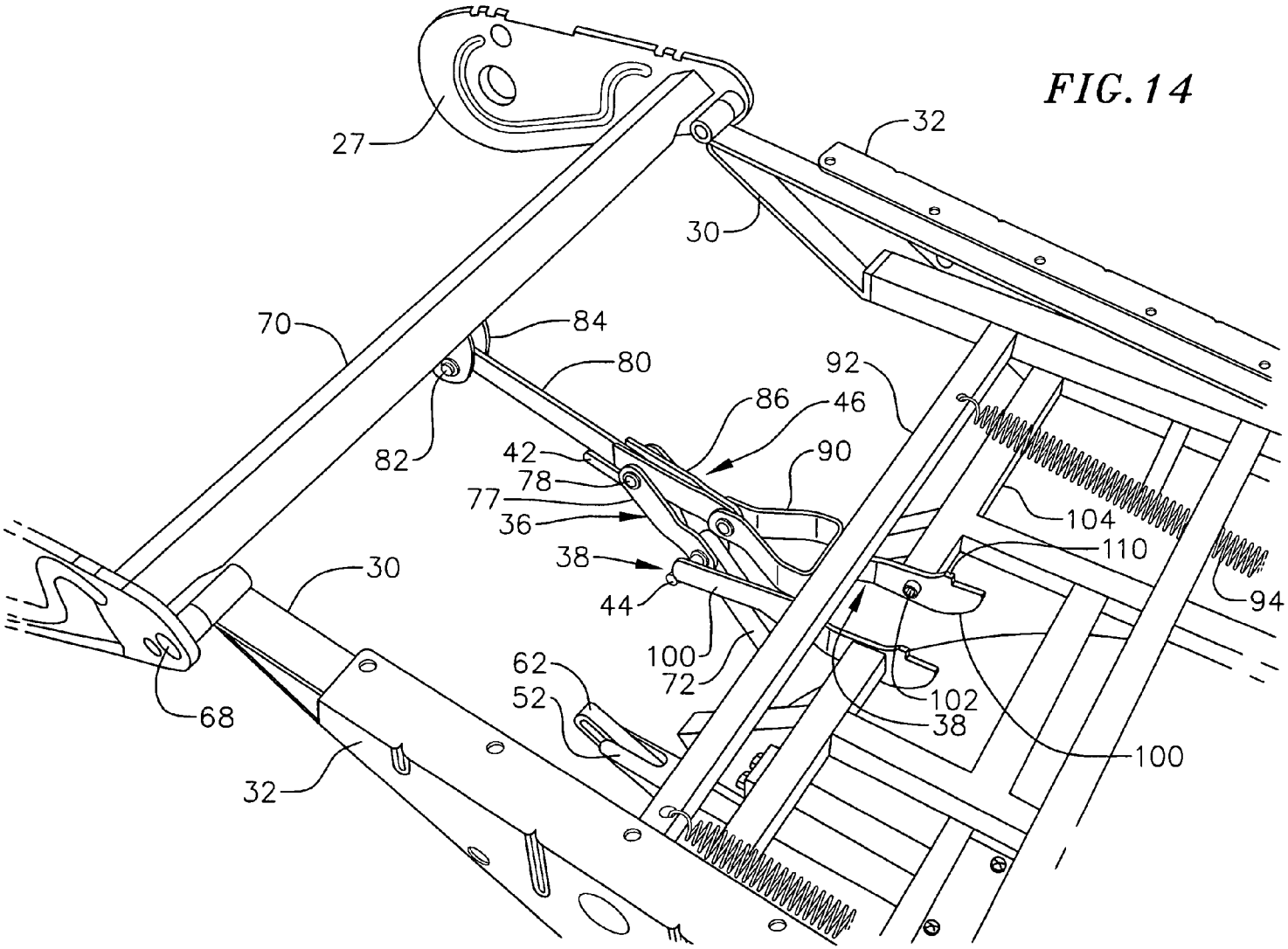
FIGS. 14 through 16 show additional vies of the extending footrest.
Figure 15:
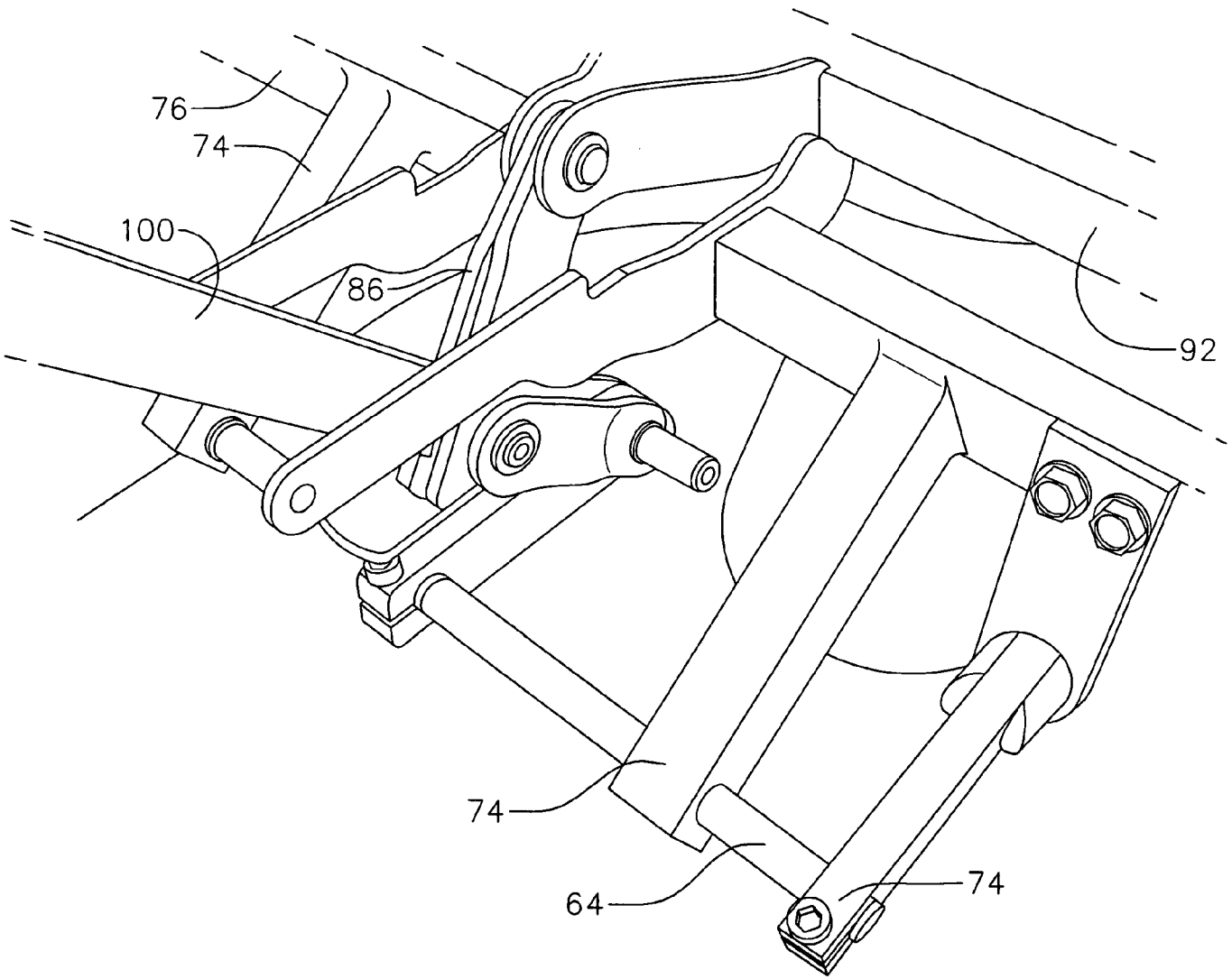
Figure 16:
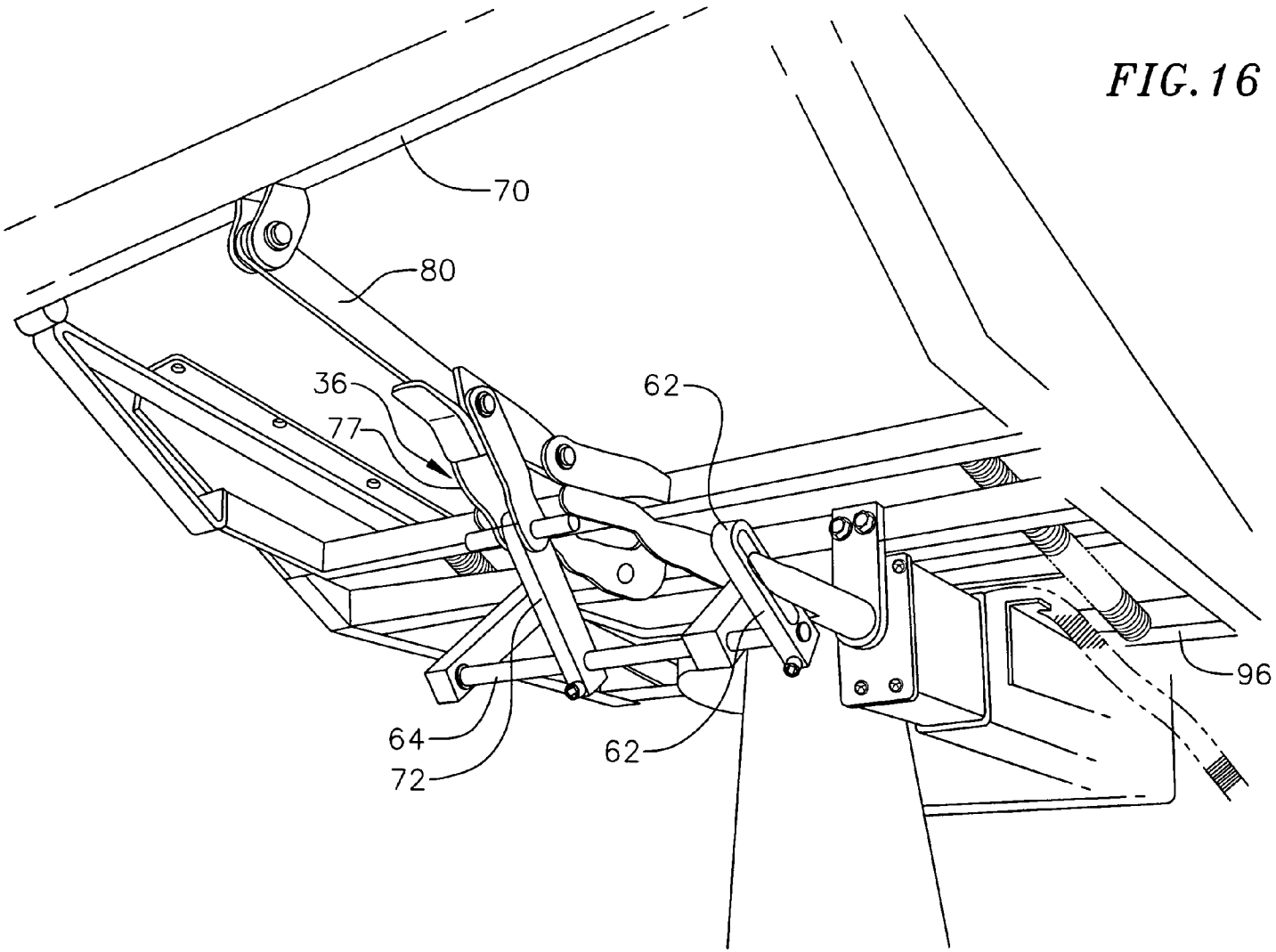

To return the footrest from the up and fully extended position shown in FIG. 13 to the down and fully retracted position shown in FIG. 10, the linear actuator is operated to move it from left to right (as viewed in FIGS. 10-13) so the retracting linkage 46, which is described in more detail in FIGS. 14-16, restores the unit to the condition shown in FIG. 10.

Referring to FIG. 14, each slide plate 27 is rigidly secured at a respective rear portion to a respective end of a transverse footrest frame beam 70. The rear end of each slide plate 27 is secured by a respective pivot pin 68 to the forward end of slide frame 30.

As shown in FIG. 14, the slide plates are in the up position and the slide frame 30 is in the extended position with respect to seat frame 32. The extending linkage 36 is locked in the up position by the footrest deployment lock 42. The extending linkage includes an upwardly and forwardly extending drive arm 72 secured at its lower and rear end to the transverse rotatable drive shaft 64 (FIG. 15) journaled in a pair of laterally spaced downwardly and forwardly extending drive shaft supports 74 secured at their upper end to a transverse member 76 of the seat frame. The forward and upper end of the drive arm 72 is pivotally secured by the transverse slide frame lock release shaft 44 to the lower end of an upwardly and forwardly extending longitudinal link 77, the upper end of which is secured by a pivot pin 78 to the rear end of a longitudinally extending link 80, the forward end of which is secured by a pivot pin 82 in a downwardly extending yoke 84 welded to the footrest frame beam 70 so that as the link 80 is moved longitudinally relative to the slide frame, the footrest frame beam 70 and side plates 27 are rotated about transverse pivot pins 68 secured to the forward end of the slide frame. The rear end of the footrest deployment lock 42 is welded to the forward end of link 77.

The retracting linkage 46 includes a longitudinally extending link 86 secured at its forward end by transverse pivot pin 78 to the rear end of link 80. The rear end of link 86 is secured by a transverse pivot pin 78 to a yoke 90 welded to a cross beam 92 of the slide frame. A pair of laterally spaced longitudinally extending tension springs (slide frame retract springs) are each connected at a respective forward end to the beam 92, and at their respective rear end, to a transverse member 96 of the seat frame as shown in FIG. 16.

Thus, when the control is operated to retract the slide frame from the extended position shown in FIG. 14, the reversible motor of the linear actuator retracts the push shaft 52. This rotates the drive shaft 64 and drive arm 72 in a clockwise (as viewed in FIG. 16) direction. The upper end of the drive arm pulls links 77 and 80 rearwardly, thereby moving the slide frame 30 to the retracted position in the seat frame, which includes a stop (not shown) for limiting the inward travel of the slide frame relative to the seat frame. As the slide frame reaches the stopped (retracted) position, link 86 of the retracting linkage 36 forces pivot pin 78 downwardly, causing the footrest deployment lock 42 to move downwardly so the pivot pin 78 and the extending linkage is free to move downwardly so that further retraction of the linear actuator causes the link 80 to continue retracting and pivot the footrest frame beam 70 and side plates 27 in a counterclockwise position direction about pivots 68 until the footrest side plates are in the down position, that is, in the position shown in FIG. 1A. To provide a smooth transition of the extending linkage from the locked to the unlocked position, a torsion spring (not shown) is connected between the pivot pin 78 and links 77, 80 and 86.

The slide frame lock 38 (shown clearly in FIG. 14) includes a pair of elongated laterally spaced and longitudinally extending pawls 100. Each pawl is secured at a respective front portion by a separate transverse pivot pin 102 to the inner end of a respective transverse beam 104 of the seat frame, so each pawl is free to pivot about a respective transverse pivot pin 102. The forward end of each pawl extends a substantial distance beyond its respective pivot pin 102. Therefore, each pawl tends to pivot in a counterclockwise direction about its respective pivot point (as viewed in FIG. 14). This causes the forward end of each slide frame lock bracket pawl 100 to rest on the slide frame lock release shaft 44 when the unit is operated to move the slide plates from the down position toward the up position. When the extending linkage is operated so the slide plates are in the down position (shown in FIG. 1A), the extending linkage is in the condition shown in FIG. 15, i.e., with a linear actuator fully retracted so the drive shaft is rotated to carry the drive arm 72 and the slide frame lock release shaft 44 to the position shown in FIG. 15. The permits each pawl 100 to pivot in a counterclockwise direction (as viewed in FIG. 15), so the forward end of each pawl bears upwardly against the underside of transverse beam 92 of the slide frame. An upwardly extending projection 110 on each pawl fits against the forward face of transverse beam 92, so the slide frame is locked against forward movement from the fully retracted position until the drive shaft rotates sufficiently to carry the slide frame lock release shaft 44 upwardly to engage the underside of each pawl, and pivot each pawl in a clockwise direction (as viewed in FIGS. 14 and 15), so the upwardly extending projection 110 at the forward end of each pawl, will no longer interfere with the forward movement of the slide frame relative to the seat frame. With each pawl in the locking position, the slide frame cannot move forward, and the side plates of the footrest frame are locked in whatever intermediate position is set by the control. Thus, even though the slide frame is not extended, the footrest can be inclined at any desired position and held there by the action of the slide frame lock.

As the extending linkage is operated to move it toward the locked position shown in FIG. 14 (and before the slide frame moves forward), the footrest locking bracket 42, locks the extending linkage in the locked position shown in FIG. 14 just as the slide frame lock release shaft lifts the forward end of each pawl to release the slide frame for forward movement in response to further actuation by the linear actuator. Thereafter, as the linear actuator continues to rotate the drive shaft in a counterclockwise direction (as viewed in FIG. 16), the slide frame is free to move forward from the retracted to the extended position, where it is stopped by the gear drive in the linear actuator reaching the extended limit. In retracting the slide frame to the retracted position in the seat frame, the linear actuator and associated linkages move the slide frame as previously described until it engages the stop (not shown) on the seat frame. Further retraction of the linear actuator and push shaft causes the extending linkage to unlock and permit the footrest side plates to be moved to the down position.

Figure 17:
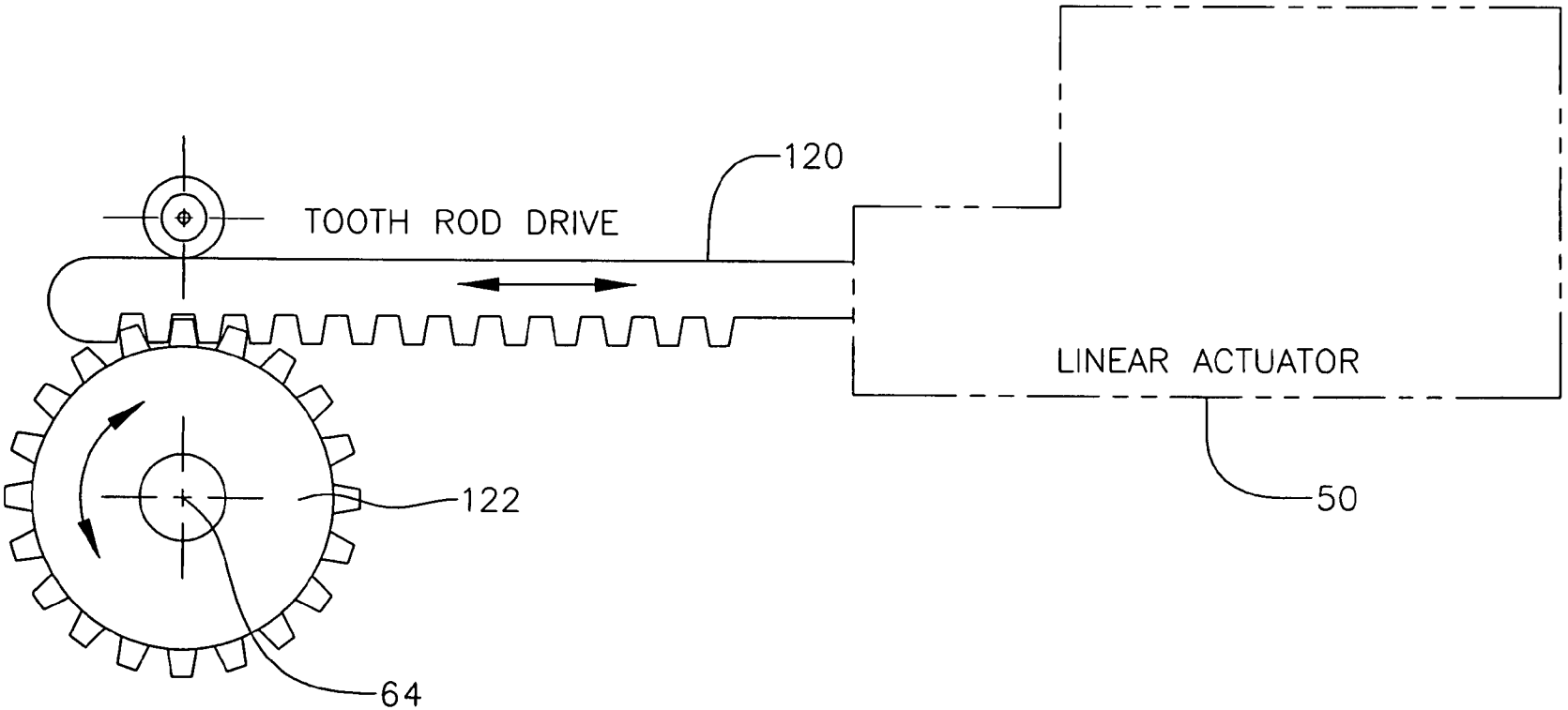
FIGS. 17 through 20 show various ways for powering the drive shaft of the extendable footrest.

FIGS. 17-20 show various ways for powering the drive shaft 64. Referring to FIG. 17, the linear actuator 50 reciprocates a tooth rod drive shaft 120 to rotate a drive gear 122 and drive shaft 64 in either a clockwise or counterclockwise direction.

Figure 18:
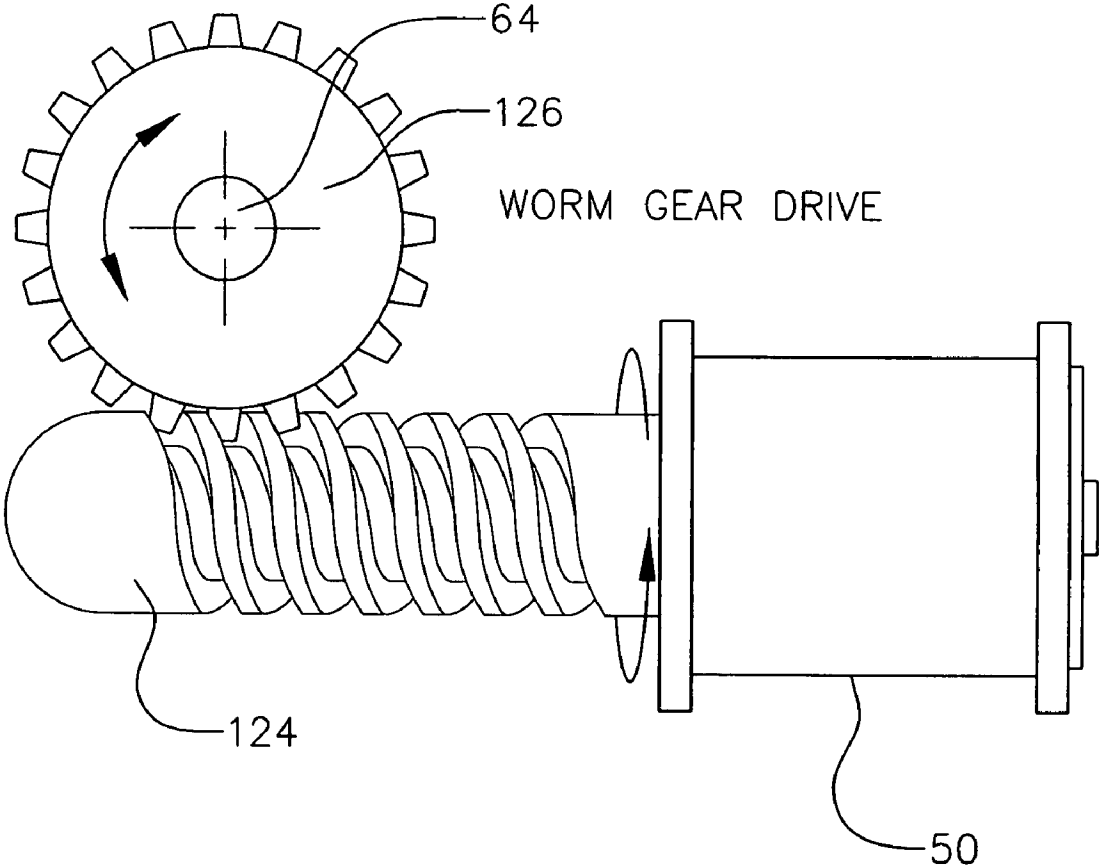

Referring to FIG. 18, the linear accelerator turns a worm gear 124, which rotates a drive gear 126 and drive shaft 64 in either a clockwise or counterclockwise direction.

Figure 19:
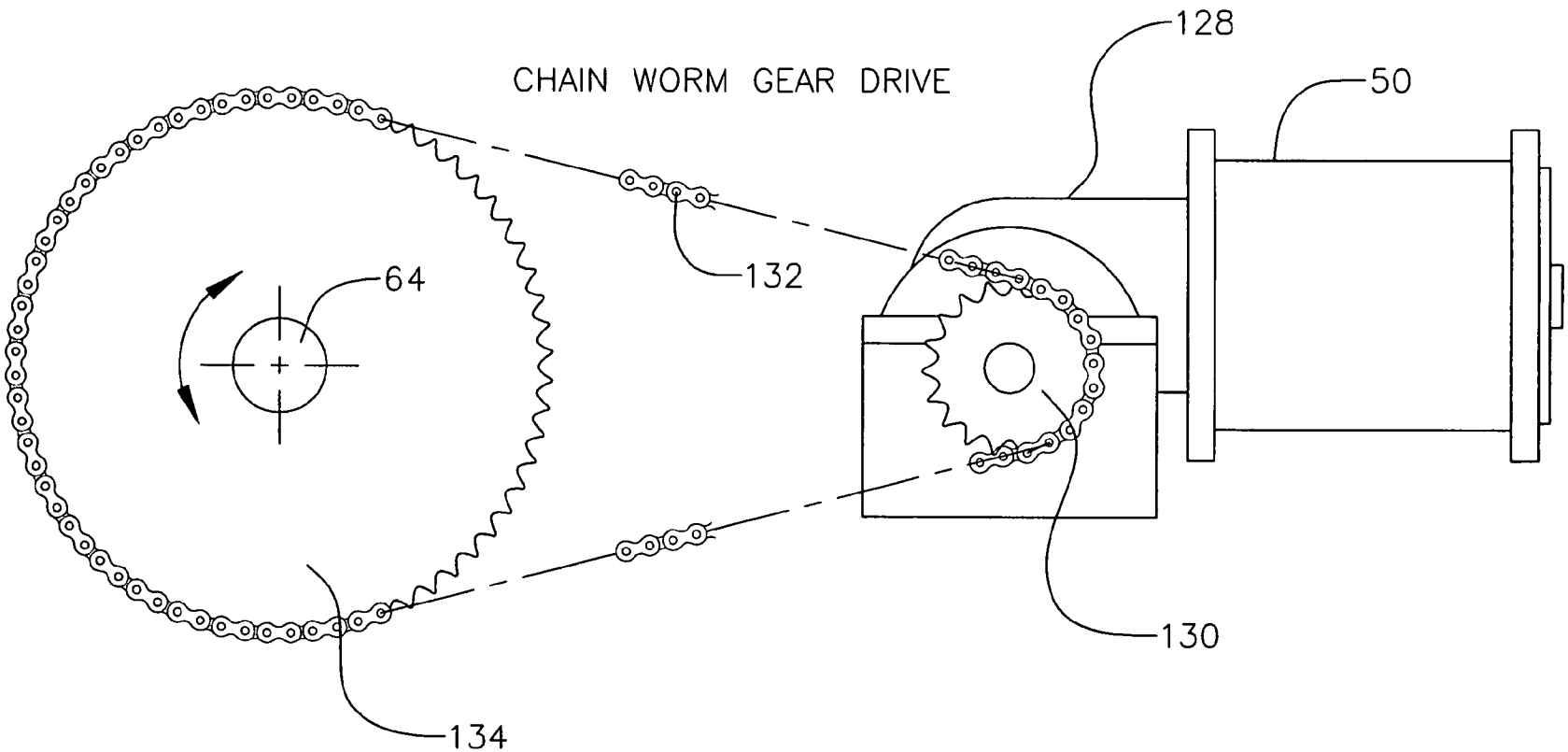

In the embodiment shown in FIG. 19, the linear accelerator operates a gear reduction drive 128 to rotate a drive sprocket 130 in either a clockwise or counterclockwise direction. A chain 132 connects the drive sprocket to a driven sprocket 134 which turns drive shaft 64 in either a clockwise or counterclockwise direction.

Figure 20:
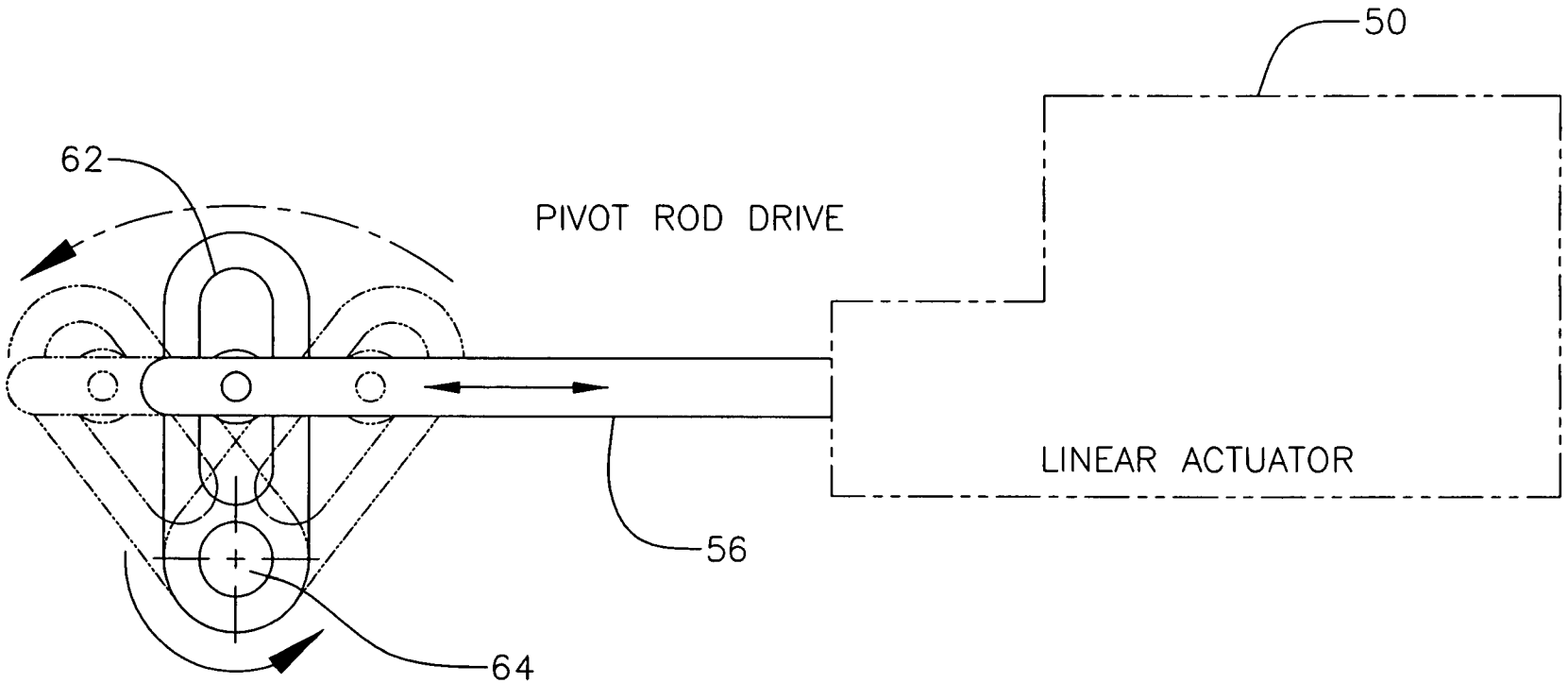

The embodiment shown in FIG. 20 is similar to that previously described in detail above, and which the linear accelerator 50 reciprocates push shaft 56 to reciprocate crank arm 62 and turn drive shaft 64 in either a clockwise or a counterclockwise direction.

What is claimed is:

1. A chair comprising:

a seat frame;

a slide frame mounted to slide on the seat frame between a retracted and an extended position;

a footrest frame mounted on the slide frame to move between down and up positions;

a rotatable drive shaft mounted on the seat frame;

an elongated drive arm secured at a first end to the drive shaft;

an extending linkage connected between a second end of the drive arm and the slide frame to move the footrest frame from the down to the up position and thereafter move the slide frame from the retracted to the extended position, when the drive shaft is rotated in a first direction; and a retracting linkage connected between the second end of the drive arm and the slide frame to move the slide frame from the extended to the retracted position with the footrest frame in the up position when the drive shaft is rotated in a second direction opposite the first direction.

2. A chair according to claim 1 which includes a slide frame lock bracket secured to the seat frame to prevent the footrest frame from moving toward the down position when the footrest frame is between the up and down positions.

3. A chair according to claim 1 which includes a footrest locking bracket on the extending linkage to lock the footrest frame in the up position when the slide frame is moved from the retracted position.

* * * * *

UNITED STATES PATENT AND TRADEMARK OFFICE

CERTIFICATE OF CORRECTION

PATENT NO. : 7,325,878 B1
APPLICATION NO. : 10/850822
DATED : February 5, 2008
INVENTOR(S) : Hans Dehli It is certified that error appears in the above-identified patent and that said Letters Patent is hereby corrected as shown below:

On the Title Page

(73) Assignee, line 1 Delete "Interactice",
Insert --Interactive--

Signed and Sealed this

Ninth Day of September, 2008

JON W. DUDAS
*Director of the United States Patent and Trademark Office*